US005833131A

United States Patent [19]

Levi

[11] Patent Number: 5,833,131

[45] Date of Patent: Nov. 10, 1998

[54] TWO-PIECE BOX CONSTRUCTION HAVING ADJUSTABLE SIZE CONTROL

[75] Inventor: Hans L. Levi, Seattle, Wash.

[73] Assignee: Baldwin Technology Corporation, Rosemont, Ill.

[21] Appl. No.: 692,075

[22] Filed: Aug. 7, 1996

[51] Int. Cl.[6] ..... B65D 5/32

[52] U.S. Cl. ..... 229/103.2; 229/122.23; 493/84; 493/183

[58] Field of Search ..... 229/23 A, 23 AB, 229/103.2, 122.23; 206/424; 493/84, 89, 138, 141, 149, 151, 152, 162, 183

[56] References Cited

U.S. PATENT DOCUMENTS

| | | | |
|---|---|---|---|
| 1,125,535 | 1/1915 | Hoffman | 229/103.2 |
| 3,666,166 | 5/1972 | Freakes | 229/23 AB |
| 3,952,672 | 4/1976 | Gordon et al. | 229/23 AB |
| 4,322,028 | 3/1982 | Kawahara | 229/103.2 |

FOREIGN PATENT DOCUMENTS

| | | | |
|---|---|---|---|
| 0 445 390 A1 | 9/1991 | European Pat. Off. . | |
| 2311729 | 12/1976 | France | 206/424 |
| 2 297 785 | 8/1979 | France . | |
| 256951 | 1/1912 | Germany . | |
| G 93 07 353 U | 9/1993 | Germany . | |
| 375944 | 10/1939 | Italy | 229/23 A |

*Primary Examiner*—Gary E. Elkins
*Attorney, Agent, or Firm*—Roberts & Mercanti, LLP

[57] ABSTRACT

Corrugated box constructions suitable for packaging, storing and transporting flat rectangular objects such as books and the like. The box has an upper member and a lower member, each with a generally rectangular central panel, a pair of side panels, one of which is hingedly joined to each of the opposite ends of the central panel. Attached to each side panel of the upper member is an underlying panel and attached each side panel of the lower member is an overhanging panel. The side panels of the lower member fold upward, then the overhanging panel folds parallel to the central panel. The side panels of the upper member fold perpendicularly downward, then underlying panel folds under the central panel of the lower member. The upper member is attached to the lower member with an optional adhesive or strap. Preferably an adhesive is situated on the overhanging and underlying panels. The construction allows for packaging products of various sizes and hence greatly reduces waste.

20 Claims, 4 Drawing Sheets

TWO-PIECE BOX CONSTRUCTION HAVING ADJUSTABLE SIZE CONTROL

BACKGROUND OF THE INVENTION

1. Field of the Invention

The present invention relates to box constructions. More particularly, the invention pertains to box constructions suitable for packaging, storing and transporting flat rectangular objects of any size such as books and the like.

2. Description of the Prior Art

It is well known in the art to produce shipping and storage boxes in a wide variety of sizes and shapes. The most common is a hollow, six-sided cubic or three dimensional rectangular structure having corrugated cardboard side walls as well as top and bottom closures. It is also well known in the art to provide storage and shipping boxes for printed materials such as books and the like. It has been a disadvantage in the book packaging industry to provide means for wrapping books of varying sizes. Typically, an individual box size is needed for the dimensions of a given book size. Clearly a book which is too large for its packaging either will not fit or will deform the box. Objects which are smaller than the box dimensions can be accommodated by either using padding or else they will be jogged within the box during shipping and hence subject to damage. This arrangement requires that the packager keep a large inventory of different box sizes for shipping objects of varying sizes. The present invention provides a two-piece carton which can effectively serve a large range of book sizes. The invention provides a carton for packaging books and other similar flat, rectangular items which allows for variations in the size of the packaged product and yet provides a cushioned retention of the product without changing the carton size.

Typically, standard protective carton blanks are of a T-shaped design, and, therefore, their manufacture results in a considerable waste of material. Moreover, the normally used carton blanks, regardless of design, require special cutting dies for their manufacture. This is a considerable cost factor, especially when short production runs of varying carton sizes are required. This results in a need for a multitude of dies and substantial inventories of different carton sizes. It has been found that the two-piece carton design of this invention essentially eliminates the need for dies since the rectangular components can be manufactured on simple slitting-scoring-printing equipment, the so called "printer-slotters". It also reduces the need for a large carton blank inventory since it allows for the use of one set of rectangular blanks for the cartoning of a multitude of book sizes.

SUMMARY OF THE NVENTION

The invention provides a box construction comprising:

(A) a lower member which comprises:

(i) a rectangular central panel of flexible sheet material having a length and a width respectively defining two longitudinal ends and two transverse ends; and (ii) a pair of side panels of flexible sheet material, one hingedly joined to each of said transverse ends at first fold lines which extend a distance the entire width between said side panels and the central panel, each of said side panels being attached to an overhang panel at a second fold line parallel to said first fold line and which extends the entire width between the side panel and the overhang panel; each of said side panels being folded along said first fold lines to position the side panels above the plane of said central panel; each of said overhang panels being folded along the second fold lines to position the overhang panel into a plane parallel to, above, and spaced from said central panel; and (B) an upper member which comprises:

(a) a rectangular central panel of flexible sheet material having a length and a width respectively defining two longitudinal ends and two transverse ends; and (b) a pair of side panels of flexible sheet material, one hingedly joined to each of said transverse ends at first fold lines which extend a distance the entire width between said side panels and the central panel, each of said side panels being attached to an underlying panel at a second fold line parallel to said first fold line and which extends the entire width between the side panel and the underlying panel; each of said side panels being folded along said first fold lines to position the side panels below the plane of said central panel; each of said underlying panels being folded along the second fold lines to position the underlying panel into a plane parallel to, below, and spaced from said central panel;

(C) the upper member being attached to the lower member such that the rectangular central panel (B)(a) is juxtaposed with the overhang panel and the underlying panels are juxtaposed with the rectangular central panel (A)(i) and extend the entire distance along the longitudinal ends of the rectangular central panel (A)(i).

The invention also provides a method for forming a box which comprises:

A. providing a lower shell member comprising:

i) a rectangular central panel of flexible sheet material having a length and a width respectively defining two longitudinal ends and two transverse ends; and ii) a pair of side panels of flexible sheet material, one hingedly joined to each of said transverse ends at first fold lines which extend a distance the entire width between said side panels and the central panel, each of said side panels being attached to an overhang panel at a second fold line parallel to said first fold line and which extends the entire width between the side panel and the overhang panel;

I) folding each of said side panels along said first fold lines to position the side panels above the plane of said central panel;

II) folding each of said overhang panels along the second fold lines to position the overhang panel into a plane parallel to, above, and spaced from said central panel; and B. providing an upper shell member comprising:

a) a rectangular central panel of flexible sheet material having a length and a width respectively defining two longitudinal ends and two transverse ends; and b) a pair of side panels of flexible sheet material, one hingedly joined to each of said transverse ends at first fold lines which extend a distance the entire width between said side panels and the central panel, each of said side panels being attached to an underlying panel at a second fold line parallel to said first fold line and which extends the entire width between the side panel and the underlying panel;

I) folding each of said side panels along said first fold lines to position the side panels below the plane of said central panel;

II) folding each of said underlying panels along the second fold lines to position the underlying panel into a plane parallel to, below, and spaced from said central panel; and C. attaching the upper member to the lower member such that the rectangular central panel (B)(a) is juxtaposed with the overhang panel and the underlying panels are juxtaposed with the rectangular central panel (A)(i) and extend the entire distance along the longitudinal ends of the rectangular central panel (A)(i).

DETAILED DESCRIPTION OF THE PREFERRED EMBODIMENT

Figure 1:
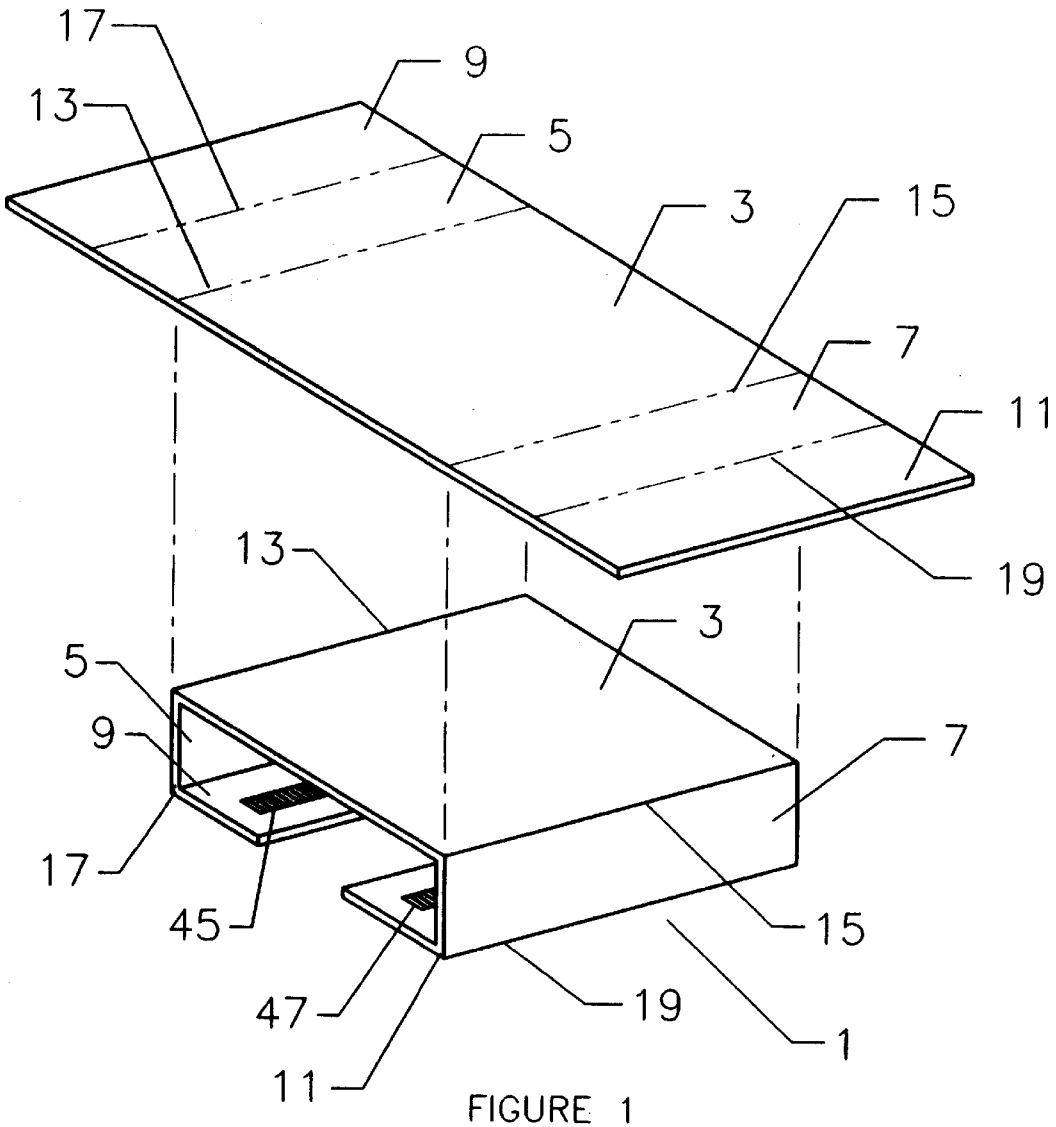
FIG. 1 is a perspective view of an upper member, before and after folding, which forms the cover of the two-piece carton assembly according to the invention.
Figure 2:
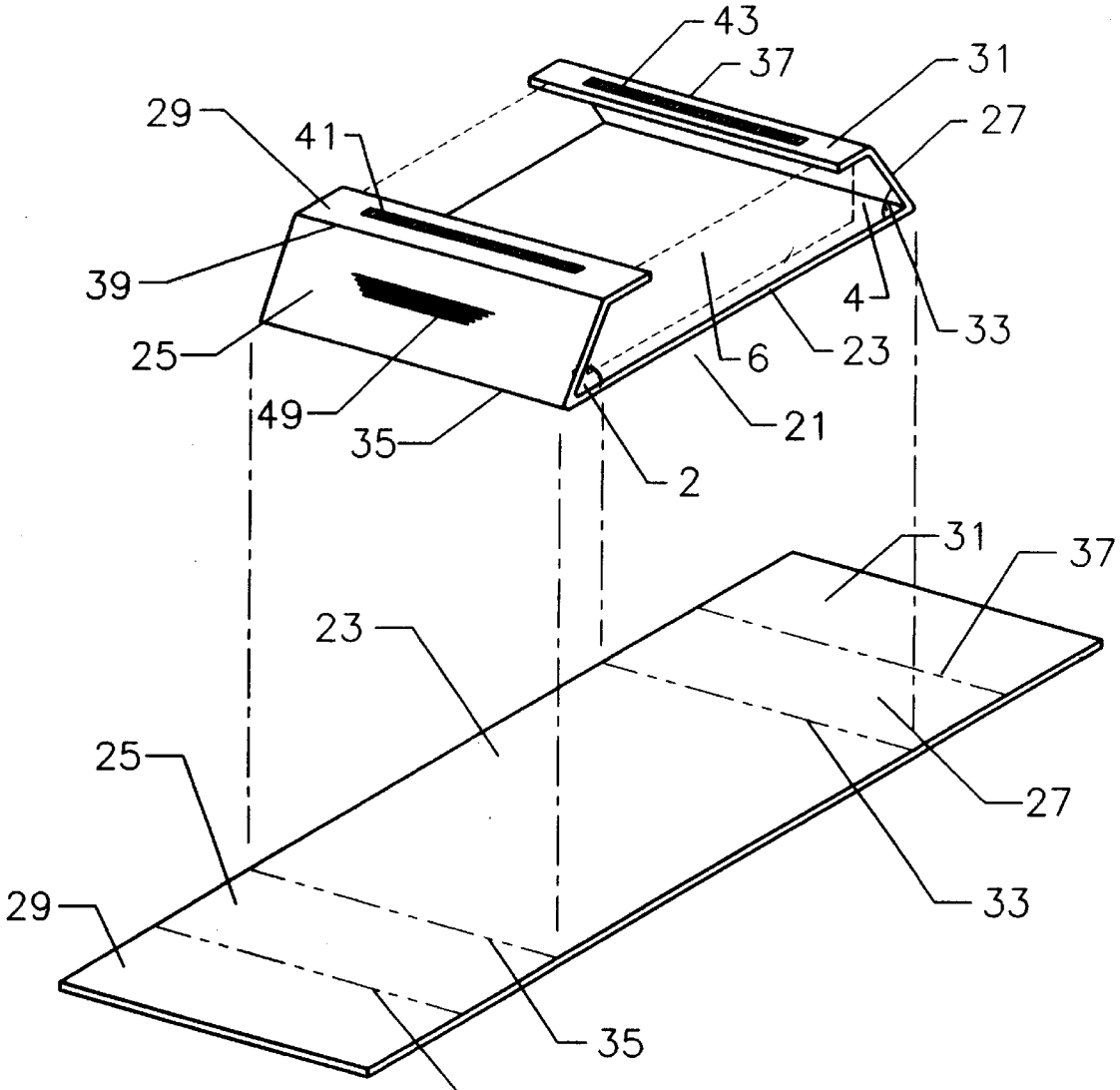
FIG. 2 is a perspective view of a lower member, before and after folding, which forms the base of the two-piece carton assembly according to the invention.

In the practice of the present invention, a two-piece box construction is prepared which is comprised of an upper member 1 and a lower member 21, as shown in FIGS. 1 and 2. Upper member 1, as shown in FIG. 1, comprises a central panel 3 having rectangular side panels 5 and 7 hingedly joined on its transverse ends at first fold lines 13 and 15. Side panels 5 and 7 are approximately equal in size. Attached to each side panel at second fold lines 17 and 19 are underlying panels 9 and 11, respectively. Underlying panels 9 and 11 are approximately equal in size. In a preferred embodiment, side panels 5 and 7 are folded downward along first fold lines 13 and 15 into a plane perpendicular to and below that of central panel 3. Underlying panels 9 and 11 are then folded along second fold lines 17 and 19 into a plane parallel to and spaced from central panel 3 as shown in FIG. 1.

Referring to FIG. 2, lower member 21 comprises a central panel 23 having rectangular side panels 25 and 27 hingedly joined on the transverse ends at first fold lines 33 and 35. Side panels 25 and 27 are approximately equal in size. Attached to each side panel at second fold lines 37 and 39 are overhang panels 29 and 31, respectively. Overhang panels 29 and 31 are approximately equal in size. In a preferred embodiment, side panels 25 and 27 of the lower member 21 are folded upward into a plane above that of central panel 23 forming angles 2 and 4. The angles 2 and 4 of this plane, with respect to the central panel 23, vary according to the size of the object to be accommodated. Angles 2 and 4 are approximately equal in size. In one embodiment of the invention, angles 2 and 4 are each approximately ninety degrees. In alternate embodiments of the invention, angles 2 and 4 are less than ninety degrees. After folding panels 25 and 27, panels 29 and 31 are then folded into a plane parallel to, above, and spaced from the central panel 23 as shown in FIG. 2.

In use, side panels 25 and 27 of the lower member 21 are folded upward into a plane above that of central panel 23 along first fold lines 33 and 35, to form angles 2 and 4 which conform to the size of the object 6 being packaged. Overhang panels 29 and 31 are then folded along second fold lines 17 and 19 into a plane parallel to and spaced from the central panel 23 to hang over the object 6 to be packaged as shown in FIG. 2. Preferably overhanging panels 29 and 31 are provided with adhesive strips 41 and 43.

Figure 3:
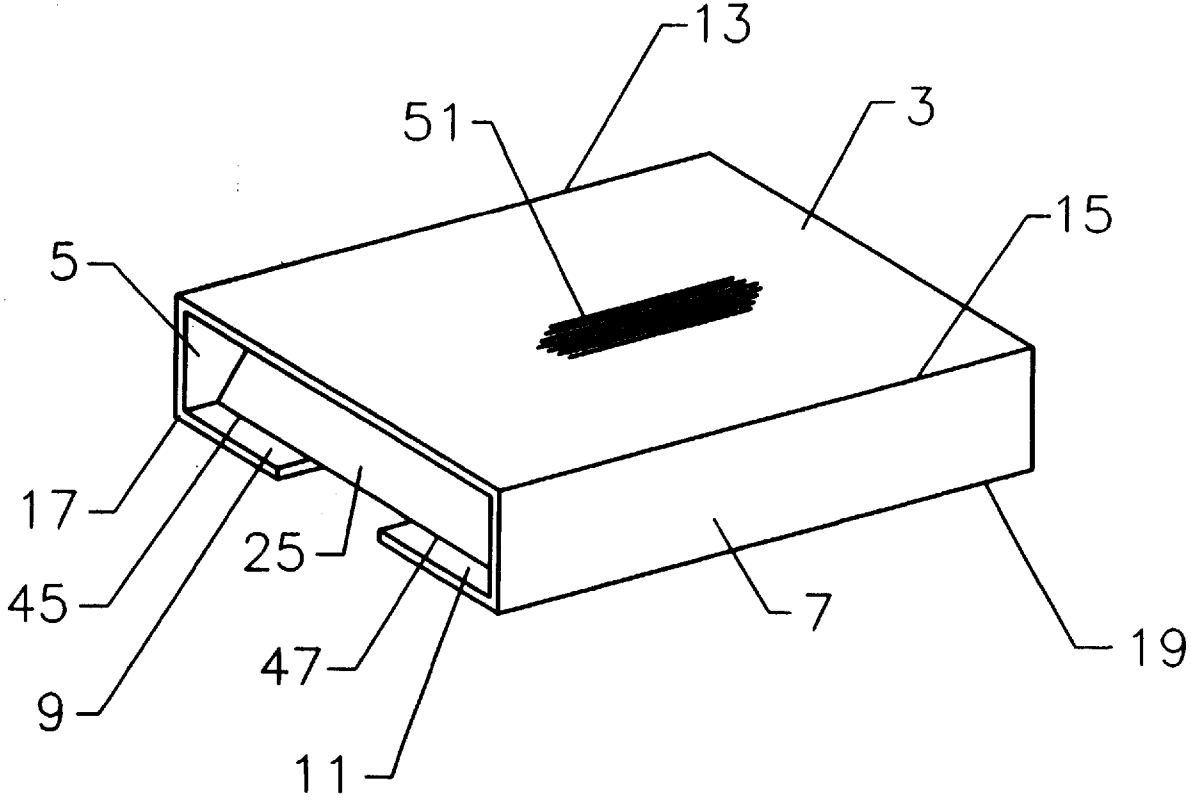
FIG. 3 is a perspective view of an assembled carton after the upper member has been attached to the lower member.
Figure 4:
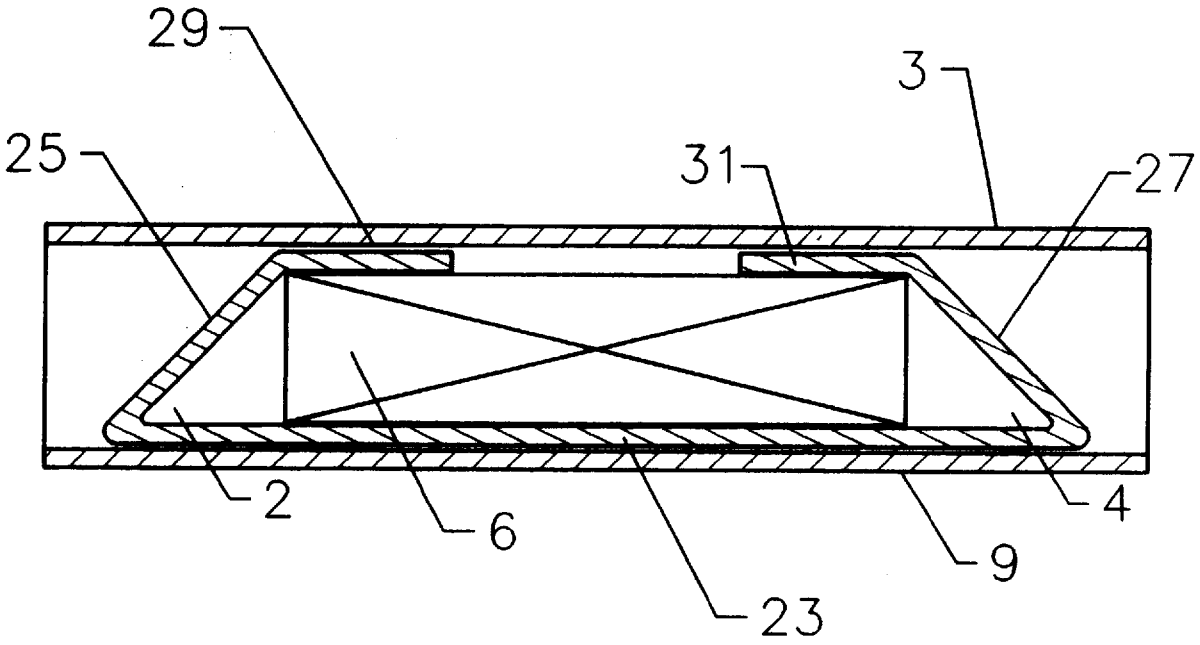
FIG. 4 is a cross-sectional view of an assembled carton containing a book after the upper member has been attached to the lower member.

The central panel 3 of upper member 1 is then placed onto overhang panels 29 and 31, where the optional adhesive strips 41 and 43 adhere the tops of overhanging panels 29 and 31 to the underside of the central of the upper member. In another embodiment of the invention, a strap 50 can encircle the lower member panels and the therein contained object to be packaged. Side panels 5 and 7 of the upper member are then folded downward along first fold lines 13 and 15 at a ninety degree angle with respect to central panel 3. Underlying panels 9 and 11 are then folded along second fold lines 17 and 19. Preferably underlying panels 9 and 11 are and adhered to the bottom of central panel 23 of lower member 21 by optional adhesive strips 45 and 47. Alternatively, the upper member can be attached to the lower member and the therein contained object to be packaged by a strap which encircles the upper and lower members. In the preferred embodiment, upper member 1 is either the same size as lower member 21, or is slightly larger than lower member 21. The completed box construction with upper member 1 adhered to lower member 21 is shown in FIG. 3, and a cross-sectional view thereof is shown in FIG. 4.

In the preferred embodiment, the upper member 1 and the lower member 21 are composed of flat sheet material such as paperboard, fiberboard, paperboard coated with plastic, or most preferably corrugated cardboard. Corrugated cardboard is constructed to have internal fluting as is well known in the art. Such fluting comprises a plurality of spaced, parallel ridges sandwiched between two sheets of flat cardboard. In the preferred embodiment, the upper and lower members are positioned such that the fluting 51 of the upper member is perpendicular to the fluting 49 of the lower member. This gives the entire arrangement added strength. This allows the upper member 1 and a lower member 21 act reciprocally to provide strength and rigidity to the box as a whole when the corrugated cardboard is constructed with the direction of corrugation lines or fluting either being longitudinal or transverse to the blank sheet from which the members are made. In the most preferred embodiment, each of upper member 1 and lower member 21 are composed of corrugated cardboard having corrugation lines displaced 90 degrees from one another. That is each one has longitudinally extending corrugation lines along its length, however, the placement of the members has the corrugation lines situated perpendicular to each other. This provides for added box strength.

The materials selected and the thickness thereof may vary depending on the cost, weight, and strength characteristics desired. Such materials are well known in the art. The fold lines may be scored by known methods. The depth of the score lines is determined by the selection of desired material for the intended use. Each of upper member 1 and lower member 21 are of unitary construction capable of being manufactured shipped, handled and stored in a flat configuration as shown in FIGS. 1 and 2 and may be readily folded and adhered together into the desired box construction either by machinery or a unskilled labor in a very short time. In the preferred embodiment, the outer surfaces of the box construction can be provided with any desired indicia such as advertising information, labels, product specifications and the like.

Another advantage to the use of this box construction is reduced waste material in production of upper member 1 and lower member 21. Upper member 1 and lower member 21 are substantially identical rectangular pieces of flat sheet material which do not require cutting dies. Only simple slitting-scoring-printing equipment is required. Not only does this reduce the amount of waste material, but it also reduces the need for carton blank inventory since it allows for the use of one set of rectangular blanks for the cartoning of a multitude of book sizes. This invention further allows for two different materials to be used for the two different members of the box construction. The lower member 21, as shown in FIG. 2, which is almost non-visible after assembly of the carton, can be made of a low-grade, low-cost material; the visible upper member 1, as shown in FIG. 1, can be made of a higher quality so that a high quality appearance can be achieved at a greatly reduce cost.

The advantage achieved by the two-piece box construction described herein is its adaptability to different book dimensions, allowing the use of one set of blanks for cartoning varying book sizes without any change-over to different carton blanks or of the cartoning machine. As shown in FIG. 2, the lower member 21 is formed around the object, which may be of any size fitting into the base-panel of the lower member 21, in such a way that the side panels 25 and 27 and the location of scores 37 and 39 adjust themselves to the size of the object. In the preferred embodiment, the material is of light weight and narrow corrugation lines, therefore enabling scores 37 and 39 to break easily around the object edges without any pre-scoring. This is done automatically in a cartoning machine by existing mechanical means. Coincidingly, the object will fit tightly into the wrap-around, holding it anchored in place during shipping.

What is claimed is:

1. A box construction comprising:

(A) a lower member which comprises:

(i) a lower rectangular central panel of flexible sheet material having a length and a width respectively defining two longitudinal ends and two transverse ends; and (ii) a pair of side panels of flexible sheet material, each side panel being hingedly joined to one of said transverse ends at a first fold line which extends a distance the entire width between said side and the central panel, each of said side panels being attached to an overhang panel at second fold lines parallel to said first fold lines and which extend the entire width between the side panels and the overhang panels; each of said side panels being folded along one of said first fold lines to position the side panels above a plane of said central panel; each of said overhang panels being folded along one of the second fold lines to position the overhang panels into a plane parallel to, above, and spaced from said central panel; and (B) an upper member which comprises:

(a) an upper rectangular central panel of flexible sheet material having a length and a width respectively defining two upper longitudinal ends and two upper transverse ends; and (b) a pair of upper side panels of flexible sheet material, each upper side panel being hingedly joined to one of said upper transverse ends at an upper first fold line which extends a distance the entire width between said upper side panel and the upper central panel, each of said upper side panels being attached to an underlying panel at upper second fold lines parallel to said upper first fold lines and which extend the entire width between the upper side panels and the underlying panels; each of said upper side panels being folded along one of said upper first fold lines to position the upper side panels below a plane of said upper central panel; each of said underlying panels being folded along one of the upper second fold lines to position the underlying panel into a plane parallel to, below, and spaced from said upper central panel;

(C) the upper member being attached to the lower member such that the upper rectangular central panel is directly connected to the overhang panels and both the underlying panels are directly connected to the lower rectangular central panel and extend the entire distance along the longitudinal ends of the lower rectangular central panel; and wherein the upper member is larger in size than the lower member.

2. The box construction of claim 1 wherein the upper member is attached to the lower member by means of a strap.

3. The box construction of claim 1 wherein the upper member is attached to the lower member by means of an adhesive between the upper rectangular central panel and the overhang panels.

4. The box construction of claim 1 wherein the upper member is attached to the lower member by means of ant adhesive between the underlying panels and the lower rectangular central panel.

5. The box construction of claim 1 wherein the upper member is attached to the lower member by means of an adhesive between the upper rectangular central panel and the overhang panels and an adhesive between the underlying panels and the lower rectangular central panel.

6. The box construction of claim 1 wherein the upper member and the lower member are comprised of a material selected from the group consisting of cardboard, corrugated cardboard, paperboard and a plastic.

7. The box construction of claim 1 wherein the upper member and the lower member are comprised of corrugated cardboard having internal parallel fluting.

8. The box construction of claim 1 wherein the upper member and the lower member are comprised of corrugated cardboard having internal parallel fluting and the upper member fluting is perpendicular to the lower member fluting.

9. A method for forming a box which comprises:

A. providing a lower member comprising:

i) a lower rectangular central panel of flexible sheet material having a length and a width respectively defining two longitudinal ends and two transverse ends; and ii) a pair of side panels of flexible sheet material, each side panel being hingedly joined to one of sail transverse ends at a first fold line which extends a distance the entire width between said side panel and the central panel, each of said side panels being attached to an overhang panel at second fold lines parallel to said first fold lines and which extend the entire width between the side panels and the overhang panels;

I) folding each of said side panels along said first fold lines to position the side panels above a plane of said central panel at an angel of less than ninety degrees with respect to said central panel;

II) folding each of said overhang panels along the second fold lines to position the overhang panels into a plane parallel to, above, and spaced from said central panel; and B. providing an upper member comprising:

a) an upper rectangular central panel of flexible sheet material having a length and a width respectively defining two upper longitudinal ends and two upper transverse ends; and b) a pair of upper side panels of flexible sheet material, each upper side panel being hingedly joined to one of said upper transverse ends at an upper first fold line which extends a distance the entire width between said upper side panel and the upper central panel, each of said upper side panels being attached to an underlying panel at upper second fold lines parallel to said upper first fold lines and which extend the entire width between the upper side panels and the underlying panels;

I) folding each of said upper side panels along said upper first fold lines to position the upper side panels below a plane of said upper central panel;

II) folding each of said underlying panels along the upper second fold lines to position the underlying panel into a plane parallel to, below, and spaced from said upper central panel; and C. attaching the upper member to the lower member such that the upper rectangular central panel is directly connected to the overhang panels and both the underlying panels are directly connected to the lower rectangular central panel and extend the entire distance along the longitudinal ends of the lower rectangular central panel.

10. The method of claim 9 wherein the side panels of the lower member are folded at a ninety degree angle with respect to the central panel.

11. The method of claim 9 wherein the upper member is attached to the lower member by means of a strap.

12. The method of claim 9 wherein the upper member is attached to the lower member by means of an adhesive between the upper rectangular central panel and the overhang panels.

13. The method of claim 9 wherein the upper member is attached to the lower member by means of an applying an adhesive between the underlying panels and the lower rectangular central panel.

14. The method of claim 9 wherein the upper member is attached to the lower member by means of applying an adhesive between the upper rectangular central panel and the overhang panel and applying an adhesive between the underlying panels and the lower rectangular central panel.

15. A box construction comprising:

(A) a lower member which comprises:

(i) a lower rectangular central panel of flexible sheet material having a length and a width respectively defining two longitudinal ends and two transverse ends; and (ii) a pair of side panels of flexible sheet material, each side panel being hingedly joined to one of said transverse ends at a first fold line which extends a distance the entire width between said side panel and the central panel, each of said side panels being attached to an overhang panel at second fold lines parallel to said first fold lines and which extend the entire width between the side panels and the overhang panels; each of said side panels being folded along one of said first fold lines to position the side panels above a plane of said central panel, at an angle of less than ninety degrees with respect to said central panel; each of said overhang panels being folded along one of the second fold lines to position the overhang panels into a plane parallel to, above, and spaced from said central panel; and (B) an upper member which comprises:

(a) an upper rectangular central panel of flexible sheet material having a length and a width respectively defining two upper longitudinal ends and two upper transverse ends; and (b) a pair of upper side panels of flexible sheet material, each upper side panel being hingedly joined to one of said upper transverse ends at an upper first fold line which extends a distance the entire width between said upper side panel and the upper central panel, each of said upper side panels being attached to an underlying panel at upper second fold lines parallel to said upper first fold lines and which extend the entire width between the upper side panels and the underlying panels; each of said upper side panels being folded along one of said upper first fold lines to position the upper side panels below a plane of said upper central panel; each of said underlying panels being folded along one of the upper second fold lines to position the underlying panel into a plane parallel to, below, and spaced from said upper central panel;

(C) the upper member being attached to the lower member such that the upper rectangular central panel is juxtaposed with the overhang panels and both the underlying panels are juxtaposed with the lower rectangular central panel and extend the entire distance along the longitudinal ends of the lower rectangular central panel.

16. The box construction of claim 15 herein the upper member and lower member are the same size.

17. The box construction of claim 15 wherein the upper member is larger in size than the lower member.

18. The box construction of claim 15 wherein the upper member is attached to the lower member by means of an adhesive between the upper rectangular central panel and the overhang panels.

19. The box construction of claim 15 wherein the upper member is attached to the lower member by means of an adhesive between the underlying panels and the lower rectangular central panel.

20. The box construction of claim 15 wherein the upper member is attached to the lower member by means of a strap.

* * * * *